United States Patent [19]

Kuzarov

[11] 4,123,040

[45] Oct. 31, 1978

[54] WINCH MOUNTING APPARATUS

[75] Inventor: Encho J. Kuzarov, Milwaukie, Oreg.

[73] Assignee: Warn Industries, Inc., Kent, Wash.

[21] Appl. No.: 783,640

[22] Filed: Apr. 1, 1977

Related U.S. Application Data

[63] Continuation of Ser. No. 615,847, Sep. 23, 1975, abandoned.

[51] Int. Cl.[2] ..... B66D 3/00

[52] U.S. Cl. ..... 254/166; 254/186 R; 308/237 R; 403/165

[58] Field of Search ..... 254/186 R, 187 R, 150 R, 254/166; 308/238 R, 72, 237 R; 198/854, 834, 725; 403/164, 165, 243, 408, 119

[56] References Cited

U.S. PATENT DOCUMENTS

| | | | |
|---|---|---|---|
| 3,557,473 | 1/1971 | Grossklaus | 198/854 X |
| 3,881,791 | 5/1975 | Hentschel | 308/238 XX |

FOREIGN PATENT DOCUMENTS

| | | | |
|---|---|---|---|
| 536,115 | 11/1931 | Fed. Rep. of Germany | 254/186 |

*Primary Examiner*—Albert J. Makay
*Assistant Examiner*—Donald W. Underwood
*Attorney, Agent, or Firm*—Graybeal, Barnard & Uhlir

[57] ABSTRACT

A winch mounted to an automobile bumper and having a cable winding drum supported between a main drive housing and an oppositely positioned idler housing. The drive housing connects to the bumper bracket by means of a pair of convexly curved mounting lugs which permit limited angular movement of the drive housing with respect to the bumper. The idler housing has a flat mounting surface which fits flush against the bumper bracket surface to prevent such angular movement. Upon distortion or misalignment of the bumper bracket, the drum is able to shift angularly with respect to the idler housing, while the other end of the drum maintains a fixed angular relationship with its bearing means in the main drive housing, which is in turn able to shift angularly with respect to the bumper bracket.

6 Claims, 5 Drawing Figures

WINCH MOUNTING APPARATUS

This is a continuation of now abandoned application, Ser. No. 615,847, filed Sept. 23, 1975.

BACKGROUND OF THE INVENTION

1. Field of the Invention

The present invention relates to a winch and particularly a winch adapted to be mounted to an automobile.

2. Description of the Prior Art

Winches are quite commonly mounted to an automotive vehicle to perform a variety of functions, such as dragging an object while the vehicle is stationary, or actually moving the vehicle itself by attaching the free end of the winch cable to a stationary object and reeling in the cable to pull the vehicle toward that object. The winch generally has its cable winding drum mounted between two end support structures which in turn are fixedly mounted to a mounting bracket at the front bumper location of the vehicle.

While the bumper bracket to which the winch is mounted is generally a strong rugged structural member, under high impact forces or severe loading on the winch cable, it is possible for the bumper bracket to become distorted or misaligned in the area of the two winch support structures. In prior art winches, when this distortion or misalignment causes a corresponding misalignment of one or both of the housing structures with respect to the drum, there is quite often a binding or misalignment of the drive components of the winch which impairs operation of the winch. Thus, it is an object of the present invention to provide an improvement for a winch such as that described above, to compensate for misalignment or distortion of the bumper bracket or other base support structure to which the winch is mounted.

SUMMARY OF THE INVENTION

The present invention is an improvement in a winch adapted to be mounted to a base support such as an automobile bumper mounting bracket. Such a winch comprises a rotatable drum for winding a cable, a drive housing containing a drive assembly and rotatably supporting a first end of the drum, and a second end structure rotatably supporting a second opposite end of the drum.

The improvement of the present invention provides for proper operation of the winch under conditions of distortion or misalignment of the base structure, hereinafter referred to as the "bumper bracket," but not intended to be limited thereto. The improvement comprises a first mounting means for the drive housing by which the drive housing is secured in a manner to permit limited angular movement about a generally vertical axis; a bearing and support means to rotatably support and retain the first drive end of the drum in the drive housing, while maintaining a substantially fixed angular relationship therebetween and restraining any relative linear movement therebetween; a second mounting means to connect the second idler support structure to the bumper bracket, this second mounting means adapted to be fixedly secured to the bumper bracket or other base support structure to prevent any angular or linear movement therebetween; and a second bearing and retaining means to support the idler end of the drum, such that limited angular and linear movement is possible between the drum and the second bearing and retaining means.

Under circumstances of misalignment or distortion of the bumper bracket or other support structure, the two housing structures are able to properly support the drum and transmit the loads therefrom into the bumper bracket. Further, the proper alignment between the main drive housing and the drum is maintained so that the drive assembly can function without any binding or misalignment of the drive components.

In the preferred form of the present invention, the mounting of the main drive housing to the bumper bracket is accomplished by providing vertical line surface contact between the mounting surface of the housing and the contact surface of the bumper bracket. Conveniently, this is accomplished by providing two mounting lugs for the drive housing, each mounting lug being convexly curved in a vertical plane (i.e., with respect to a horizontal section), so as to provide roller contact along a vertical line. Retaining bolts are inserted through the bumper bracket or other support structure to attach the housing to the bumper bracket. The other housing has a planar mounting surface which matches (i.e., fits flush against) the mounting surface of the base support structure so that when these components are secured to each other, as by bolts extending through the bumper bracket and into the second housing, the idler housing and the bumper bracket are fixedly secured to one another.

The limited angular and linear movement between the idler housing and the second end of the drum is provided by a loose tolerance bearing means. More specifically, the idler housing is provided with a large diameter bearing member of short axial length, desirably made of a moderately yielding material, so that there is sufficient contact area of the bearing member under circumstances of misalignment.

Other features of the present invention will become apparent from the following detailed description.

DESCRIPTION OF THE PREFERRED EMBODIMENTS

Figure 1:
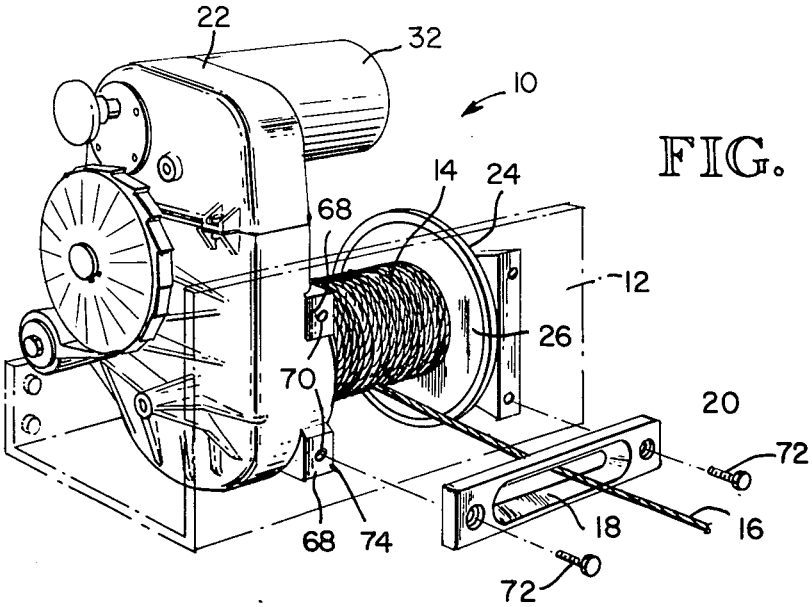
FIG. 1 is an isometric view of the winch of the present invention.
Figure 2:
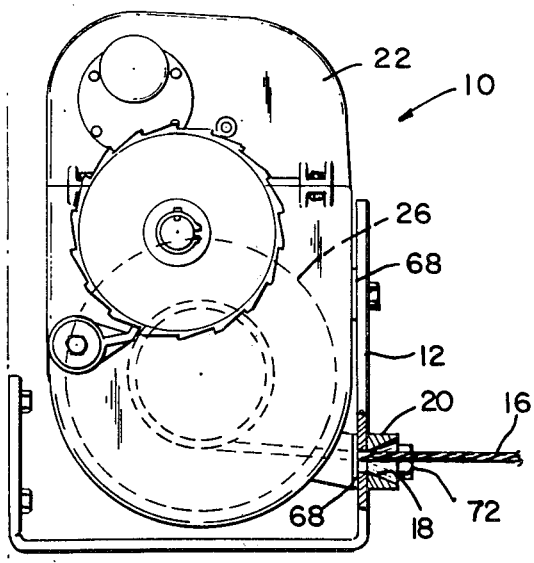
FIG. 2 is a side elevational view thereof.

In the accompanying drawing, there is shown a winch 10 mounted to a bracket 12 of a front bumper of an automotive vehicle (not shown for convenience of illustration). This winch 10 comprises a drum 14 having a cable 16 wound thereon, with the free end of the cable 16 passing through a slot 18 formed in the bumper bracket 12 and through a guideplate 20 mounted to the lower middle portion of the bumper bracket 12. The drum 14 is mounted by its end portions between two housing structures, namely a main drive housing 22 and an oppositely positioned end idler housing 24.

The components 10 through 24 described thus far are those which commonly make up the main components of an automobile mounted winch of conventional design, and for which the present invention is adapted. It is believed that a clearer understanding of the novel aspects of the present invention will be achieved by first describing the main functional features of these components 10 through 24 and the problems associated with their reliable operation.

A winch 10 such as that described herein is capable of exerting through its cable 16 a pulling force in the order of several thousand pounds. The rather substantial loads placed on the drum 14 as a result of the cable operating against a heavy load are transmitted from the drum 14 through the two housing structures 22 and 24 into the automobile bumper bracket 12. The primary function of the idler housing 24 is to provide support for the non-driven end or idler end 26 of the drum 14 and, as mentioned above, transmit the loads therefrom into the bumper bracket 12. The main drive housing 22 performs the support and force transmitting function for the opposite drive end 28 of the drum 14. In addition, the main drive housing 22 contains and supports the drive assembly 30 by which power is transmitted from an electric motor 32 to the drum 14.

This drive assembly 30 is or may be of a conventional design. In the particular configuration shown herein, the motor 32 turns a pinion gear 34 which engages a larger gear 36 of a first stage cluster gear assembly 38. A second pinion gear 40 of the first stage cluster 38 engages a second larger gear 42 which through a clutch-brake mechanism 44 drives a third pinion 46 which in turn engages a main gear 48 having a spline connection 50 to the drive end 28 of the drum 14. The drive end 28 of the drum 14 is retained in the drive housing 22 by means of a retaining plate 52 having an arcuate concave edge portion 54 which engages a circumferential recess 56 in the drive end 28 of the drum 14.

At the drive end 28 of the drum 14 just to the right of the splined connection 50 of the drum 14, there is a cylindrical bearing portion 58 mounted within a radial bearing and seal means, indicated at 60, which is in turn mounted in a matching opening 62 in the drive housing 22.

It will be noted that the various gear components 44 through 48 of the drive assembly 30 all rotate about axes which are parallel to the axis of rotation of the drum 14. For this drive assembly to operate properly, it is essential that the alignment of the drum 14 relative to the drive assembly 30 and drive housing 22 remain constant within fairly close tolerances.

It is not unusual for an automobile winch to be subjected to extremely rugged operating conditions. Even though the bumper bracket 12 to which the winch 10 is mounted is of very rugged construction, it often happens that due to some impact on the bumper bracket 12 or some exceptional load being placed on the winch 10, the bumper bracket 12 becomes bent or distorted in the area where the winch is mounted. In prior art winches, this would sometimes result in misalignment in the operating components of the winch, which in turn impairs the winch's proper operation. It is to this problem that the present invention is particularly directed.

Figure 3:
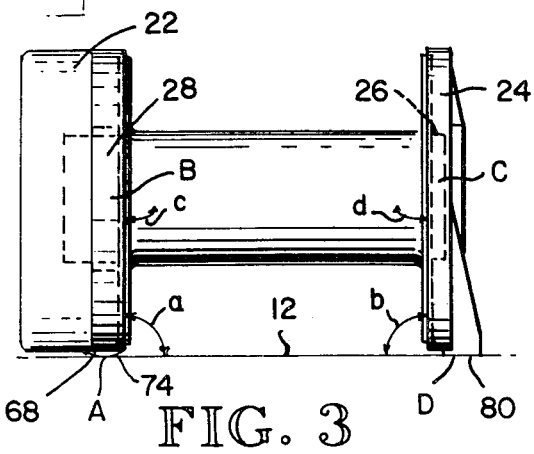
FIGS. 3 and 4 are semi-schematic top plan views, illustrating the significant functional features of the present invention.
Figure 4:
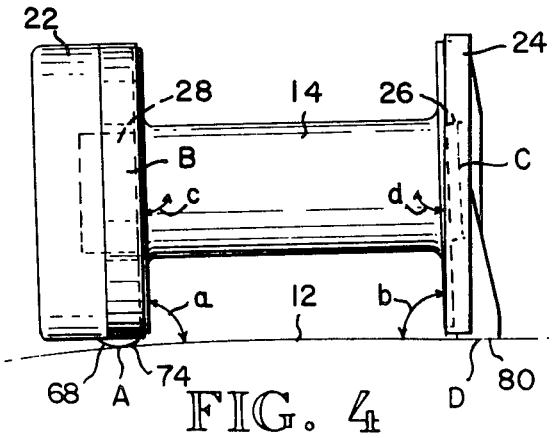
Figure 5:
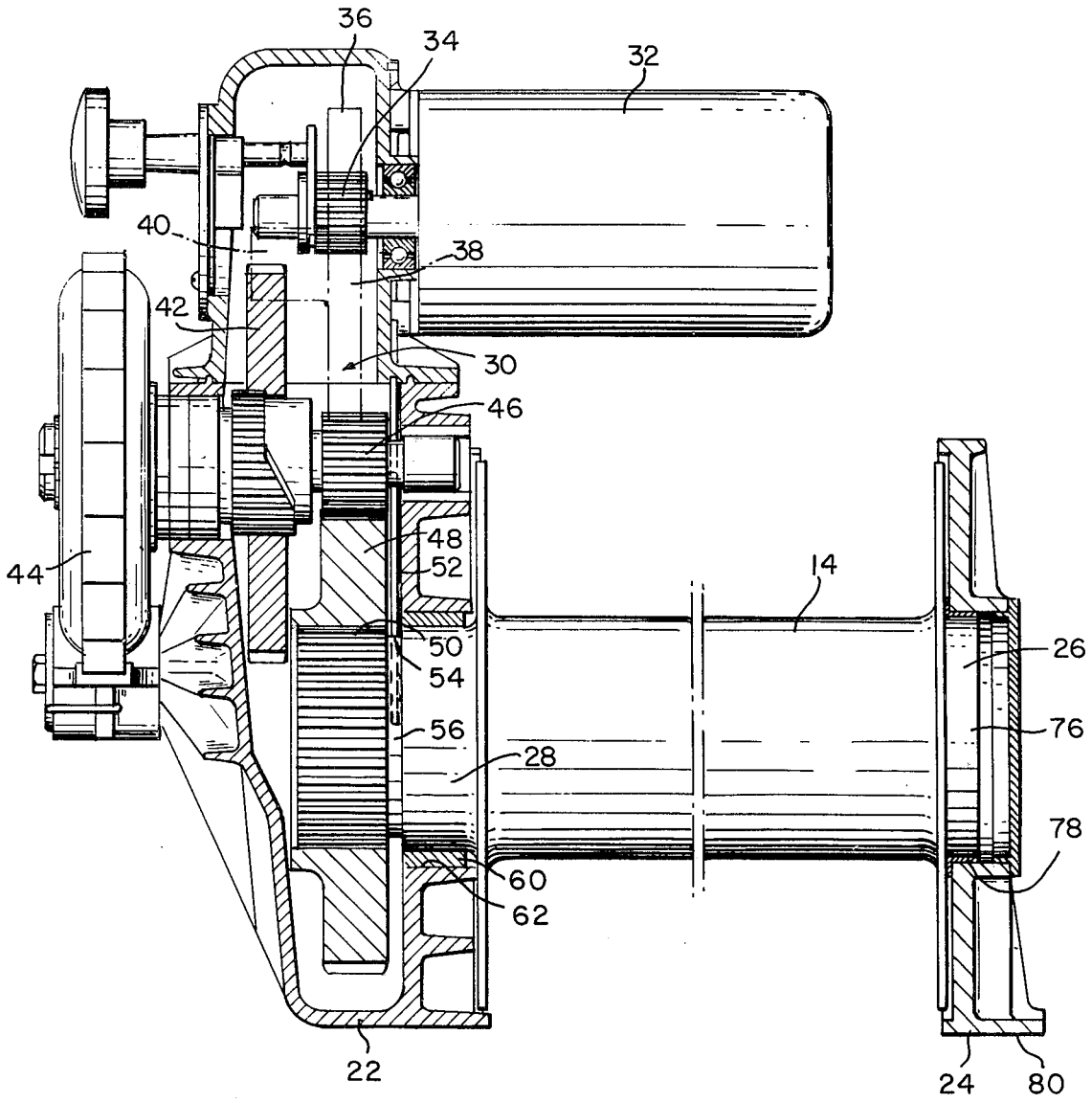
FIG. 5 is a longitudinal sectional view of the winch of the present invention.

To describe the novel aspects of the present invention, reference is now made to FIGS. 3 and 4 which illustrate the winch somewhat semi-schematically in top plan view. There are four critical locations in the combination of the present invention, namely: (a) the connection of the main drive housing 22 to the bumper bracket 12, this location being designated "A," (b) the mounting of the drive end 28 of the drum 14 to the main drive housing 22, this location being designated "B," (c) the mounting of the idler end 26 of the drum 14 to the end support housing 24, this location being designated "C," and (d) the mounting of the end support housing 24 to the bumper bracket 12, this location being designated "D."

With regard to location "A, " i.e., the mounting of the drive housing 22 to the bumper bracket 12, there are two mounting lugs 68, each having a through opening 70 to receive a related bolt 72 and a rear cavity to receive a square nut (not shown for convenience of illustration). Each bolt 72 extends through the bumper bracket 12 to secure the drive housing 22 to the bumper bracket 12. The lugs 68 are mounted one above the other in vertical alignment, and each has a contact surface 74 which is convex in horizontal cross sectional configuration. Thus, there is an angularly variable mounting between the drive housing 22 and the bumper bracket 12 in the form of "rolling contact" between these components about a vertical axis. In other words, while the drive housing 22 is fixedly connected to the bumper bracket 12 about a transverse horizontal axis (i.e., the axis parallel to the bumper) and a longitudinal axis (i.e., perpendicular to the bumper and parallel to the length of the automobile to which the bumper is mounted), the mounting of the drive housing 22 to the bumper bracket 12 is angularly variable about its vertical axis.

With regard to location "B," i.e., the connection of the drum 14 to the drive housing 22, the drive end 28 of the drum 14 is rotatably mounted in the drive housing 22 in a manner that the main axis of the drum 12 is fixed both angularly and linearly (i.e., axially) with respect to the drive housing 22. The radial bearing 60 fits closely around the bearing portion 58 of the drum 14 and has substantial axial length to prevent relative angular or radial movement within rather close tolerances and thus maintain the integrity of the seal and alignment of the various gear members within the housing 22. The retaining plate 52 limits any linear movement of the drum 14 relative to the housing 22 in a direction parallel to the axis of rotation of the drum 14. As indicated above, for the proper operation of the winch 10, it is essential that this alignment and linear position of the drum 14 relative to the drive assembly 30 and drive housing 22 remain constant within fairly close tolerances.

With regard to location "C," i.e., the mounting of the idler end 26 of the drum 14 in the idler housing 24, there is permitted limited angular movement between the drum 14 and the end housing 24 about axes generally perpendicular to the axis of rotation of the drum 14, and moderate linear movement in a direction parallel to the axis of rotation. This is accomplished by providing the extreme right end portion of the drum 14 with a cylindrical bearing portion 76 which fits with a moderately loose tolerance within a radial bearing 78 in the end housing 24. This bearing 78 is desirably made of a material which is able to yield moderately (i.e., nylon) to accommodate an angular variation of the drum 14 relative to the end housing 24. Also, while the axial length of the bearing 78 and its associated bearing portion 76 is relatively small to permit angular variation of the drum 14 relative to the end housing 14, the diameter of the bearing 78 and its associated bearing portion 76 are made relatively large to provide an adequately large bearing surface between the two.

With regard to location "D," the mounting connection of the idler housing 24 to the bumper bracket 12 is a rigid connection which permits substantially no angular or linear variation between the idler housing 24 and the bumper bracket 12. This is conveniently accomplished by providing the end housing 24 with a flat contact surface 80 which fits flush against the flat surface of the bumper bracket 12. Thus, the contact of the end housing 24 against the bumper bracket 12 has a geometric relationship where there are at least three contact points not lying in the same line, which necessarily results in a fixed angular relationship between these two components.

To describe the operation of the present invention, in FIG. 3 there is shown the winch 10 mounted to the bumper bracket 12, with the bumper bracket 12 being substantially undistorted. In this condition, there is no misalignment problem, in that the two housing structures 22 and 24 extend at right angles from the plane of the bumper bracket 12 (these angles being indicated at "*a*" and "*b*"), and the axis of rotation of the drum 14 is at right angles to the plane of each of the housings 22 and 24 (these two angles being indicated at "*c*" and "*d*").

In FIG. 4, there is shown the situation where the bumper bracket 12 has been subjected to a condition where it has become slightly distorted in the mounting area of the winch 10. In this condition, the angular position between the idler housing 24 and the bumper bracket 12 (angle "*b*") remains fixed. Likewise, the angular position between the drum 14 and the drive housing 22 (angle "*c*") remains substantially fixed. However, due to the "roller contact" mounting of the drive housing 22 against the bumper bracket 12, the angular position of the drive housing 22 relative to the bumper bracket 12 (indicated at "*a*") is able to shift moderately. (In the condition shown in FIG. 4, the drive housing 22 shifts so as to decrease the size of angle "*a.*") The connecting bolts 72 are able to yield sufficiently in thier mounting holes 70 to permit such limited angular movement. Likewise, the angular orientation of the drum 14 relative to the end housing 24 is able to change moderately. In the condition shown in FIG. 4, this occurs in a manner to decrease the size of angle "*d.*"

In the operating condition shown in FIG. 4, the relationship of the drive housing 22 and its contained drive assembly 30 relative to the drum 14 remains the same, so that the power can be properly transmitted from the motor 32 to the drive assembly 30 to the drum 14. Since the bearing mounting 76–78 of the idler end of the drum 14 permits some angular deviation relative to the end housing 24, the rotation of the drum 14 relative to the end housing 24 is not impaired. The force loads exerted by the cable on the drum 14 can be properly transferred into the two housings 22 and 24, and the mounting of the two housings 22 and 24 to the bumper bracket 12 are such that they can properly transmit the loads from the drum 14 into the bumper bracket 12. Since some linear movement of the drum 14 relative to the idler housing 24 in a direction parallel to the axis of rotation of the drum 14 is possible, the bumper bracket 12 can be distorted in a manner to move the housings 22 and 24 either closer together or further apart within moderate limits, without disturbing operation of the winch 10.

What is claimed is:

1. An improved, bumper-mounted winch assembly of the type having:

(a) a base structure, such as an automobile bumper bracket, to which the winch is mounted;

(b) a rotatable drum for winding a cable;

(c) a drive housing containing a drive assembly for said drum and supporting the driven end portion of said drum; and (d) an idler housing fastened to the base structure and supporting the opposite, idler end portion of said drum, wherein the improvement comprises:

(e) an angularly variable drive housing mounting means in line contact with said base structure, which connects said drive housing to said base structure and which permits limited angular movement of said drive housing relative to the base structure about a mounting axis, provided by such line contact, which is generally parallel to the base structure, wherein said angularly variable drive housing mounting means comprises a plurality of attachments aligned along said line contact mounting axis wherein:

(i) each attachment comprises solely a fastener and a pair of contact surfaces;

(ii) one contact surface of each said pair is a part of said drive housing and the other contact surface of each said pair is a corresponding part of said base structure;

(iii) at least one contact surface of each pair of contact surfaces is a convex protrusion;

(iv) each pair of contact surfaces is held in contact by means of said fastener; and (v) each said fastener extends completely through said base structure in an axial direction substantially perpendicular to said base structure and through said contact surfaces; whereby under conditions of distortion and misalignment of said base structure rolling contact can occur between each pair of contact surfaces, the line of contact therebetween moving laterally across said base structure in a direction substantially parallel to said base structure; and (f) mounting means for said idler end portion of said drum comprising sleeve bearing means stationary with respect to said idler housing and characterized by a relatively large diameter as compared to its axial length to provide both adequate bearing support and to permit angular motion of said idler end portion of the drum with respect to said idler housing by allowing said idler end portion to tip within said idler housing under conditions of base structure distortion and misalignment; whereby under circumstances of said base structure misalignment and distortion said angularly variable drive housing mounting means and said mounting means for said idler end portion of the drum are capable of properly compensating for said misalignment and distortion of the base structure to maintain said drum in a proper angular relationship with respect to the drive housing for proper operation of the drive components of the winch without binding, while simultaneously transmitting loads from drum to said base structure.

2. The combination as recited in claim 1, wherein one contact surface of each contact surfaces pair is a convex protrusion of substantially cylindrical cross section, and the other contact surface of each contact surfaces pair is substantially flat so that there is only line contact therebetween.

3. The combination as recited in claim 1, wherein each convex protrusion is a part of said drive housing and wherein each substantially flat contact surface is a part of said base structure.

4. The combination as recited in claim 1, wherein the diameter of said sleeve bearing means is approximately seven times its axial length.

5. The combination as recited in claim 4, wherein said sleeve bearing means is a one-piece combination thrust and radial bearing.

6. The combination as recited in claim 1, wherein said sleeve bearing means is composed entirely of a moderately yielding material such as nylon.

* * * * *